US007633835B1

(12) United States Patent
Erikson et al.

(10) Patent No.: US 7,633,835 B1
(45) Date of Patent: Dec. 15, 2009

(54) HIGH POWER, MOTOR DRIVEN UNDERWATER ACOUSTIC TRANSDUCER

(75) Inventors: Kenneth R. Erikson, Henniker, NH (US); Eric M. Will, Mont Vernon, NH (US)

(73) Assignee: BAE Systems Information And Electronic Systems Integration Inc., Nashua, NH (US)

( * ) Notice: Subject to any disclaimer, the term of this patent is extended or adjusted under 35 U.S.C. 154(b) by 19 days.

(21) Appl. No.: 11/728,849

(22) Filed: Mar. 27, 2007

Related U.S. Application Data

(60) Provisional application No. 60/786,413, filed on Mar. 27, 2006.

(51) Int. Cl.
*G10K 9/12* (2006.01)

(52) U.S. Cl. ..... 367/174; 367/142

(58) Field of Classification Search ..... 367/142, 367/148, 174, 175; 181/110, 113, 119, 120; 116/27
See application file for complete search history.

(56) References Cited

U.S. PATENT DOCUMENTS 4,667,766 A * 5/1987 Melvin ..... 181/113
5,646,380 A * 7/1997 Vaage ..... 367/142
6,085,862 A * 7/2000 Tenghamn ..... 367/142

FOREIGN PATENT DOCUMENTS

EP 1376049 A1 * 1/2004

* cited by examiner

*Primary Examiner*—Ian J Lobo
(74) *Attorney, Agent, or Firm*—Daniel J. Long

(57) ABSTRACT

A high intensity, low frequency underwater transducer for non-lethal deterrence of terrorist swimmers or divers in a body of water. The invention consists of a motor driven flex-tensional underwater transducer. In one embodiment, the phase of a transducer is sensed, enabling multiple projectors to achieve high acoustic sound pressure levels by beamforming and/or modal constructive interference (e.g. taking advantage of harbor bottom topography and boundaries.).

14 Claims, 7 Drawing Sheets

HIGH POWER, MOTOR DRIVEN UNDERWATER ACOUSTIC TRANSDUCER

CROSS REFERENCE TO RELATED APPLICATION

This application claims rights under 35 USC§ 119(e) from U.S. patent application Ser. No. 60/786,413 filed Mar. 27, 2006, the contents of which are incorporated herein by reference.

this invention was made with United States Government support under Contract No. N00014-06-C-0101 awarded ty the Office of Naval Research. The united States Government has certain rights in the invention.

BACKGROUND OF THE INVENTION

1. Field of the Invention

The present invention relates to underwater sound and more particularly to high power acoustic transducers (projectors) for applications such as non-lethal deterrence of terrorist swimmers and divers.

2. Brief Description of Prior Developments

Non-lethal swimmer and diver engagement is of increasing importance in today's threat environment because many potential terrorist targets are in areas accessible to recreational boaters or swimmers who may have no malevolent intent. The potential proximity of marine mammals also necessitates non-lethal methods.

Modern detection sonar systems are able to differentiate between marine mammals, large fish, swimmers and divers through their signature and track. They cannot, however, discern the intentions of a human in the water. Thus there is a need for a graduated system of engagement, beginning with audible warnings, sirens, etc. that should cause the casual intruder or marine life to turn away.

The later stages of engagement require a method that effectively incapacitates the intruder without lethal force, since there remains the possibility that they could be demonstrators, not terrorists. The ideal method would cause divers to surface where they could be dealt with by more conventional means.

The parameters of an ideal deterrent may be summarized to include effectiveness, high reliability, not being easily countered, using a graduated force level; non-lethality, affordability, and having size, weight and power source requirements appropriate to the application.

Short of developing the equivalent of a rubber bullet for underwater use, the candidates for non-lethal underwater deterrence are light and sound. Both can create psychophysical and/or physiological effects. Light, however, suffers from short propagation distances in the turbid water typical of many harbors and rivers. It is easily countered and does not work at all in the most turbid water.

High-intensity, low frequency sound is useful as a non-lethal means for deterring swimmers and divers who may be terrorists. The psychophysical acoustic interactions proposed to be exploited include annoyance/aversion (avoidance of a loud sound) and/or cognitive/functional task impairment (physical symptoms).

The physiological (based on frequency and sound pressure level (SPL) dependent thresholds) effects of low frequency sound are hearing (up to 160 dB SPL=minor effects) including auditory pain threshold ~220 dB SPL, vestibular function (dizziness, rotation of visual field), and bronchopulmonary resonance (coughing, gagging, choking, pain).

It is difficult to defend against low frequency sound unless one is inside a rigid body such as a vehicle. Thus, resonance of the lungs is an ideal candidate for the deterrent method. Experimental evidence suggests that the nominal resonance frequency of the human lung is about 20 to 70 Hz and is depth dependent. The in situ damage threshold to mice and guinea pig lungs is reported to be about 180 dB SPL.

What is needed for an effective deterrent for underwater terrorists, therefore, is a relatively inexpensive, high power, low frequency source of underwater sound.

SUMMARY OF INVENTION

The invention consists of a motor driven flextensional underwater transducer. In one embodiment, the phase of a transducer is sensed, enabling multiple projectors to achieve high acoustic sound pressure levels by beamforming and/or modal constructive interference (e.g. taking advantage of harbor bottom topography and boundaries.)

BRIEF DESCRIPTION OF THE DRAWINGS

The present invention is further described with reference to the accompanying drawings wherein.

DETAILED DESCRIPTION OF THE PREFERRED EMBODIMENT

As described above, sound suitable for deterring swimmers and divers must be low frequency (down to 20 Hz), high acoustical sound pressure level (SPL>195 dB re 1 μP @ 1 m), and the projector must be able to produce this sound in shallow water (as little as 25 ft deep). Historically, piezoelectric or magnetostrictive projectors capable of meeting these requirements have been expensive to produce in large part due to the volume of high cost ceramic or magnetostrictive material required. In addition, large and expensive power amplifiers are required to drive such transducers.

Of particular concern is the need to avoid cavitation which is potentially damaging to the projector. The acoustic output level that will induce cavitation decreases with decreasing depth. This projector must operate at very shallow depths. The cavitation threshold also decreases with operating frequency. The operating frequency range of this projector is very low. In order to avoid cavitation, one can increase the acoustic radiating area i.e. make the projector bigger. This increase, of course, will increase projector weight. Thus a phase synchronized array of projectors may be required to achieve the desired output.

The present invention is a low-cost projector that provides the performance described in the concept description above. To summarize, the projector preferably has the following technical characteristics:

Output Waveform: Continuous Transmission of a Single Tone

Operating Frequency Range: 20 Hz to 200 Hz

Sound Pressure Level (SPL):

Greater than 195 dB re 1 μP @ 1 m

Variable from 150 dB re 1 μP @ 1 m to full rated SPL.

Output Phase Control: Accuracy less than 1 degree.

Maximum Transmit Duration: Greater than 10 minutes

Operating Depth: 25 ft to 75 ft

Dry Weight of Deployable Components: Less than 500 lbs.

Maximizing acoustic sound pressure level is of primary importance for an effective deterrent.

Figure 1:
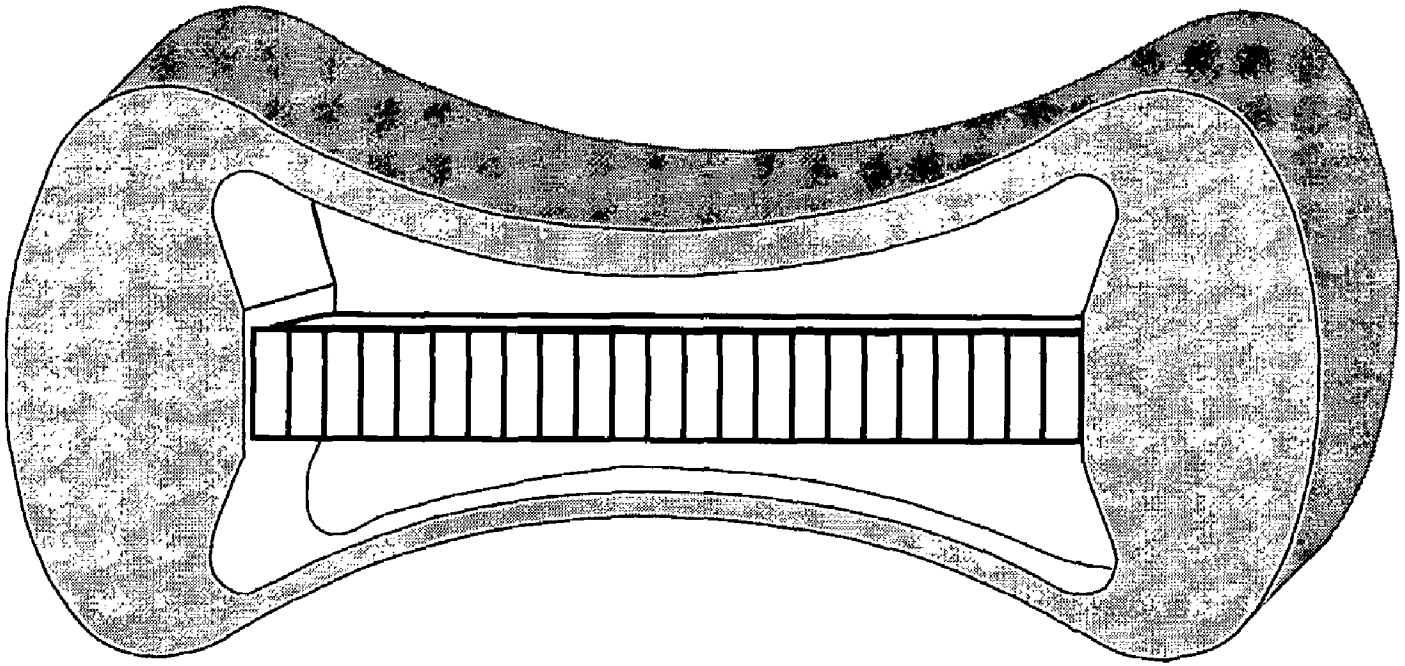
Fig. 1 Prior Art
FIG. 1 is an illustration in a perspective view of a prior art flextensional transducer.

FIG. 1 is a schematic drawing of a conventional Inverse Flextensional (Class-VII) transducer shell—an efficient sound radiator with minimal size and weight. It is typically made of aluminum and is suitable for use in practicing the method of the present invention. Other classes of flextensional shells may also be used.

Shell 1 is driven by a "stack" 3 of piezoelectric or magnetostrictive elements. By applying an AC voltage to stack 3, typically on the order of 2500 Volts, the length of the stack changes, causing the thinner sides of shell 1 to move at the AC drive frequency, but at an amplified displacement compared to the length change.

Because cost is very important for many deterrence applications, the cost of the power amplifier required for the transducer of FIG. 1 (~$30,000 for a device with the requisite output power), when added to the cost of the piezoelectric or magnetostrictive stack make this approach undesirable.

Figure 2:
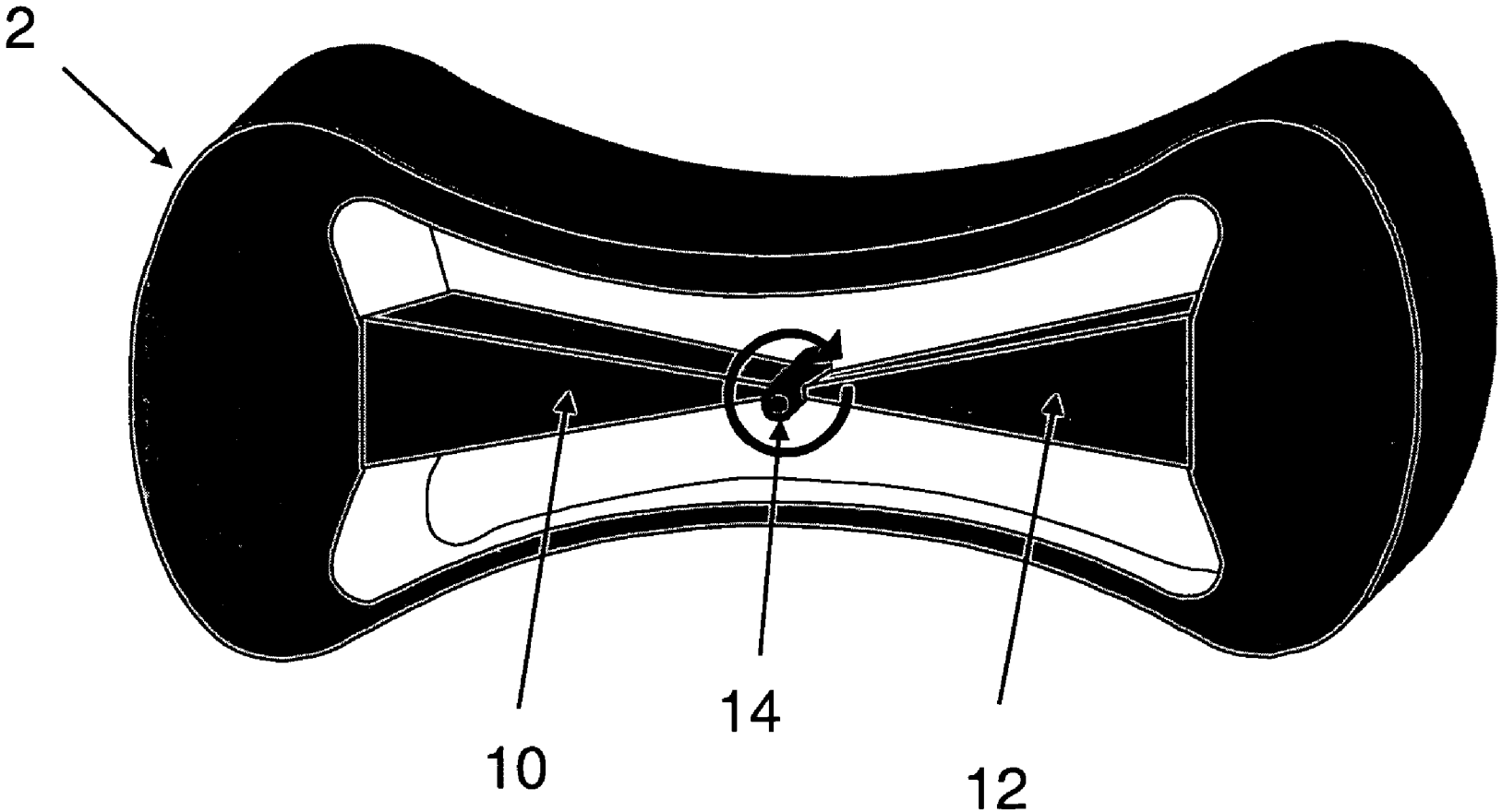
FIG. 2 is an illustration in a perspective view of a preferred embodiment of the transducer of the present invention.

FIG. 2 is an illustration of an affordable, low frequency, high sound pressure level (SPL) source that meets all the criteria outlined above. Flextensional shell 2 is similar to that of FIG. 1, with the addition of opposed interior arms 10 and 12 extending inwardly from the exterior shell to inner terminal ends. Rotating cam 14 is in contact with the inner terminal ends With a variable speed motor (not shown in FIG. 2), cam 14 provides the alternating force to drive the shell in a manner similar to the stack of a conventional transducer. By using a motor and cam in place of the power amplifier and stack, cost can be dramatically reduced. Such motors and controllers are available as relatively low cost Commercial Off-the-Shelf (COTS) products, even in low quantities.

Figure 3:
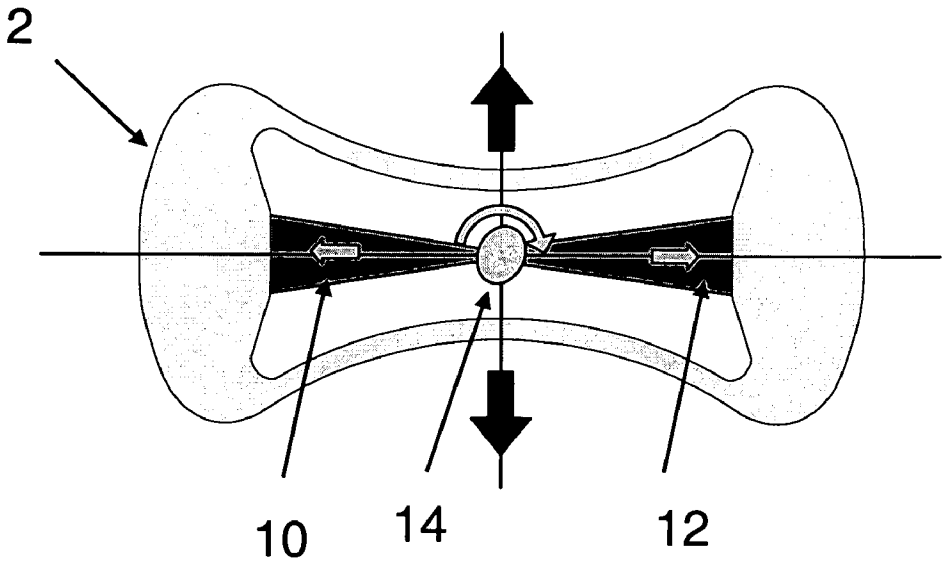
FIGS. 3 and 4 are illustrations of the mode of operation of the present invention.
Figure 4:
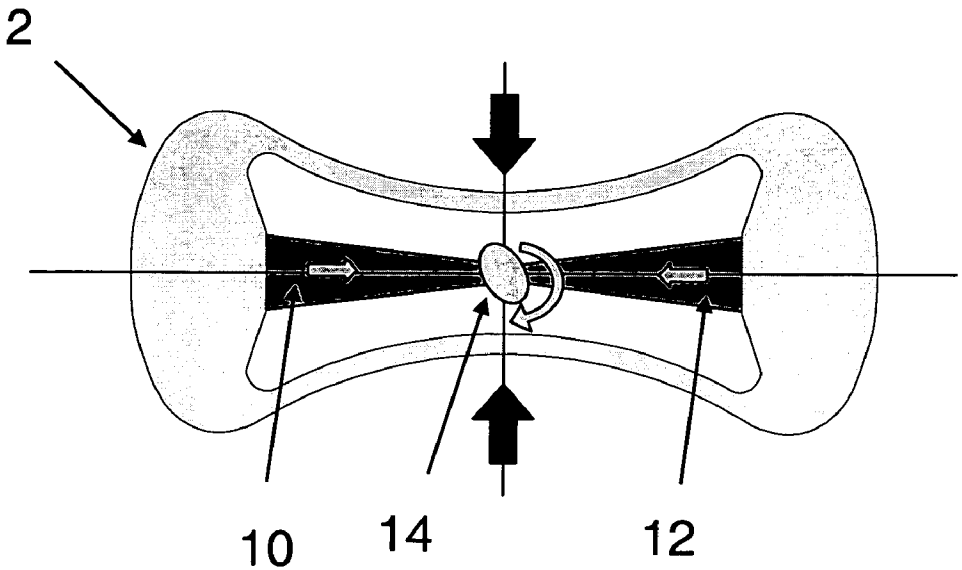

FIGS. 3 and 4, illustrate this in more detail. In FIG. 3, cam 14 is shown just beginning to force arms 10 and 12 in an outward direction, with the net result that the sides of shell 2 apart. As the cam rotates farther (FIG. 4), arms 10 and 12 move closer together, resulting in the sides of the shell moving centrally. When shell 2 is immersed in water, the rotating cam thus creates an alternating movement of the shell, and thereby produces a sound wave.

Figure 5:
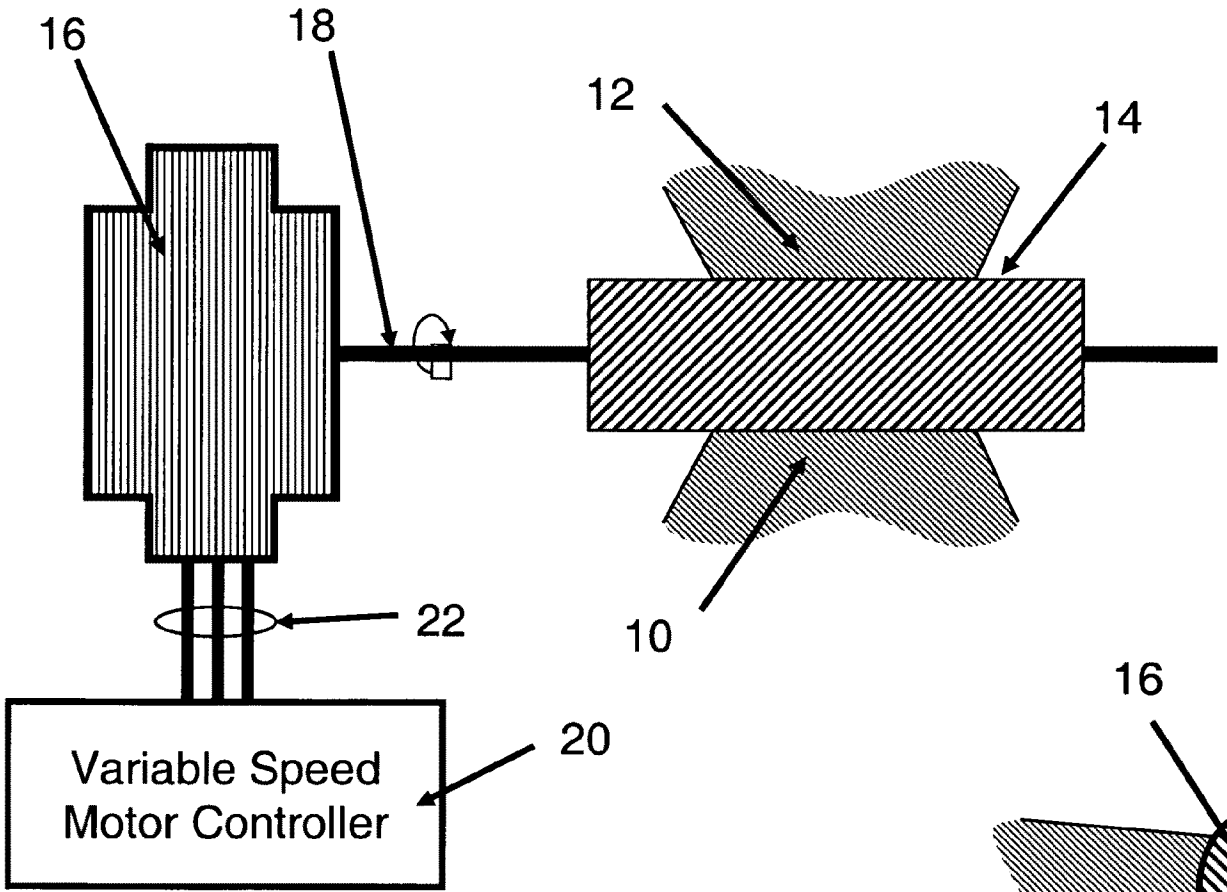
FIG. 5. is a more detailed illustration of the motor controller, motor and cam of the invention.

FIG. 5 illustrates further details of the invention. Arms 10 and 12 are moved by cam 14 shown in longitudinal cross-section. Cam 14 is rotationally driven by motor 16 via shaft 18. For clarity, details of bearing, seals, etc. that are required for implementation of the invention are not shown. Such details are obvious to those skilled in the art of mechanical design.

Motor 16 is connected to motor controller 20 by connection means 22. Motor 16 may be a rotary electrical motor or a rotary air motor. Motor controller 20 has means for maintaining a constant speed of shaft 18 as well as means for varying the rotation speed. The rotational speed determines the rate of flexure of shell 2 and thereby the frequency of the sound wave.

Figure 6:
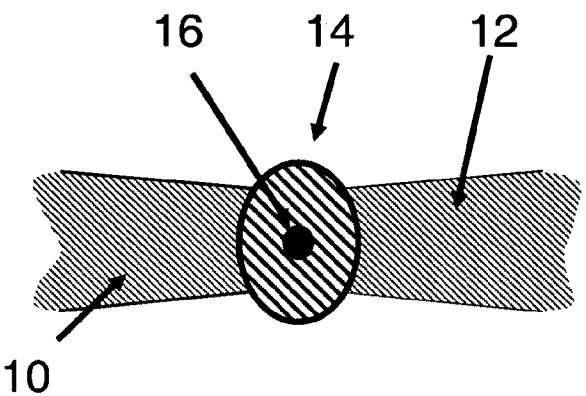
FIG. 6 is an illustration of the cam and cam follower portion of the invention as viewed along the axis of the motor shaft.

FIG. 6 illustrates cam 14 in transverse cross-section in additional detail. Arms 1 and 12 preferably remain in contact with cam 14 throughout the rotational cycle.

Figure 7:
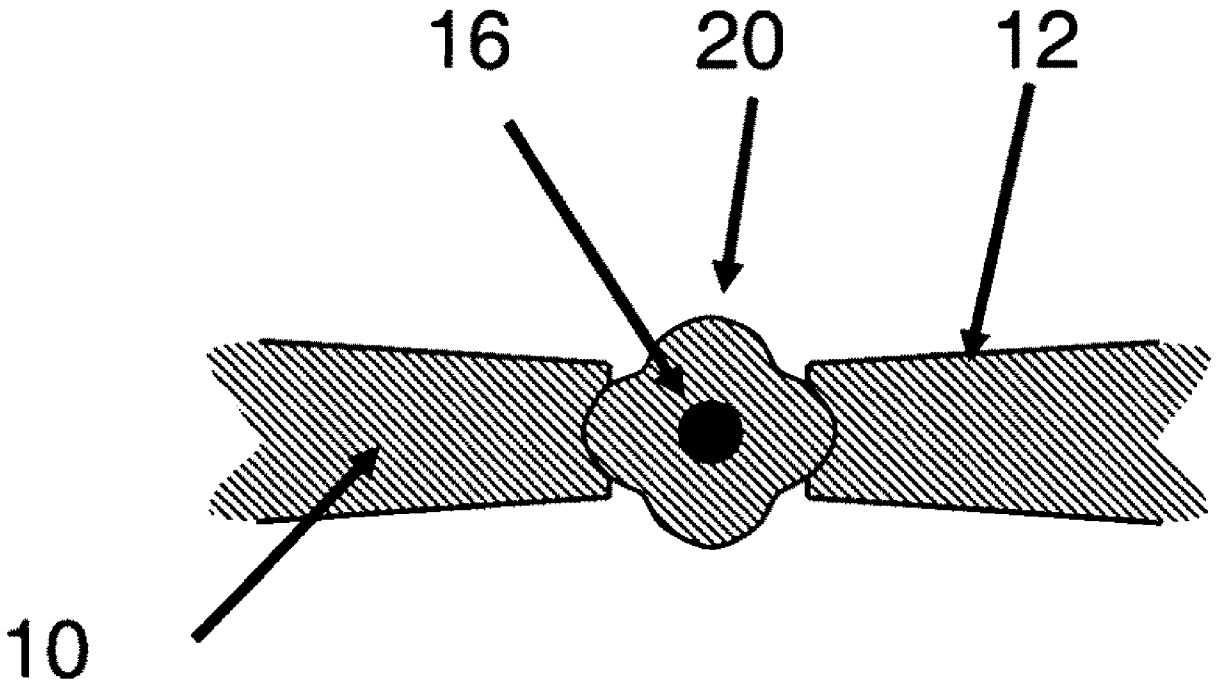
FIG. 7 is an illustration of an alternate embodiment of the cam and cam follower.

FIG. 7 illustrates an alternate embodiment. Cam 20 in this case is a four-lobed cam producing a vibrational frequency of shell 2 at twice rate of cam 14.

Figure 8:
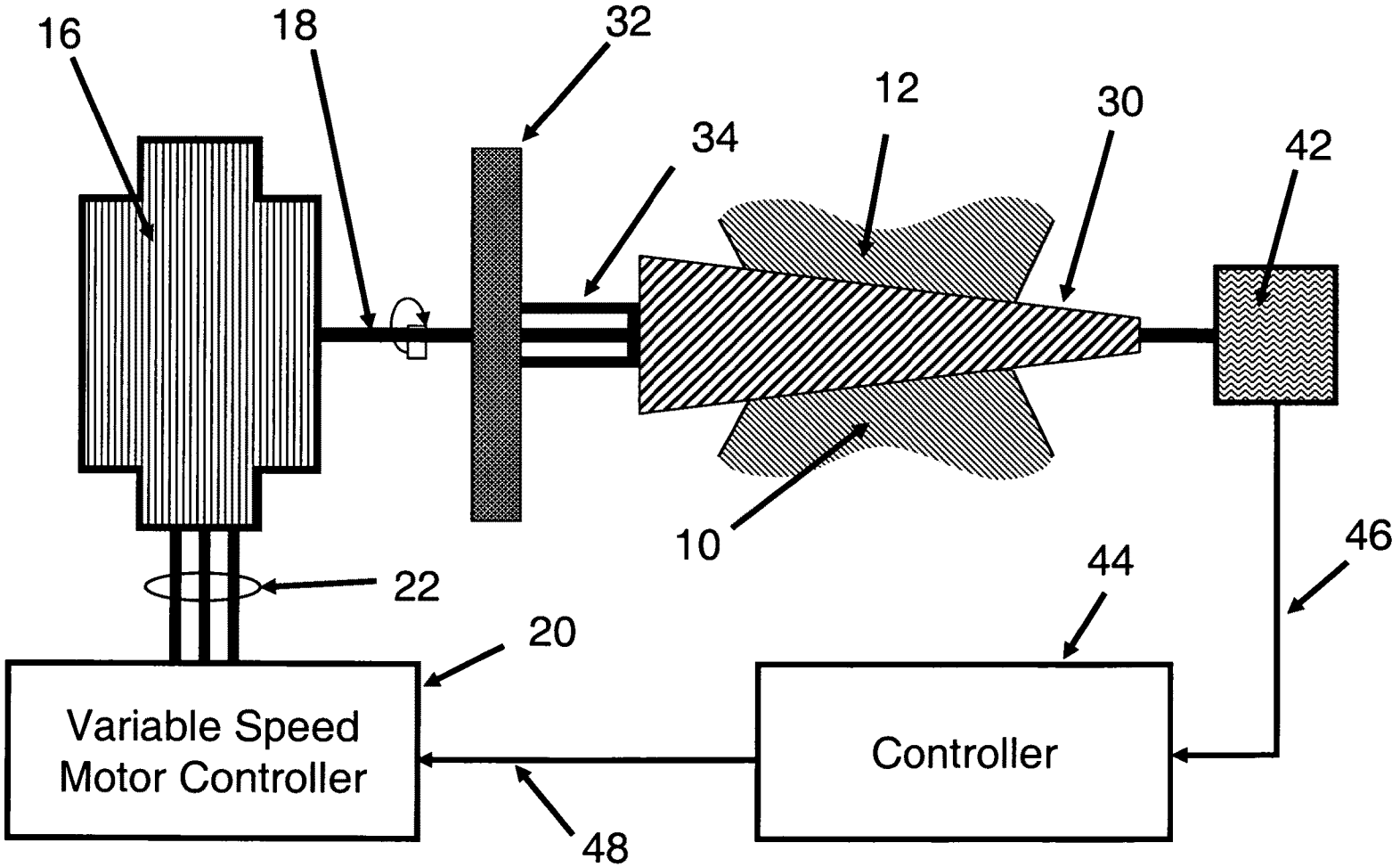
FIG. 8 is an illustration of another embodiment of the invention which includes a mechanism for adjusting the sound pressure level of the invention as well as controlling the phase of the sound wave.

FIG. 8 illustrates a preferred embodiment. In this embodiment, arms 10 and 12 have a taper to match that of tapered cam 30. Cam 30 may have a simple cross-section similar to cam 14 or may be a multi-lobed cam in cross-section similar to cam 20. Adjusting mechanism 32 and 34 provide means to adjust the position of cam 30 into the space between arms 10 and 12. As the cam is moved further into this space, the amplitude of motion of the arms and thereby shell 2 is increased, thus increasing the output sound pressure level of the transducer. Note that shaft 18 is free to rotate cam 30, independent of adjusting mechanism 32 and 34. Again, mounting brackets, seals and other mechanisms are not shown for clarity. These details are obvious to one skilled in the art of mechanical design.

In FIG. 8, sensor 42 is attached to the distal end of shaft 18. This sensor is used to detect the rotational position of shaft 18 and thereby the rotational position of cam 30. Sensor 42 may be a potentiometer, digital encoder or other type of rotational sensor. The rotational position of cam 30 is communicated to controller 44 by connection 46. Controller 44 thus not only knows the position of cam 30 at any instant, but can determine the rotational speed of the cam. This information may be sent to variable speed motor controller 20 via communication means 48. Thus, a "closed-loop" system has been disclosed, whereby both the frequency and phase of the sound wave emanating from the transducer may be kept constant or adjusted as required.

Figure 9:
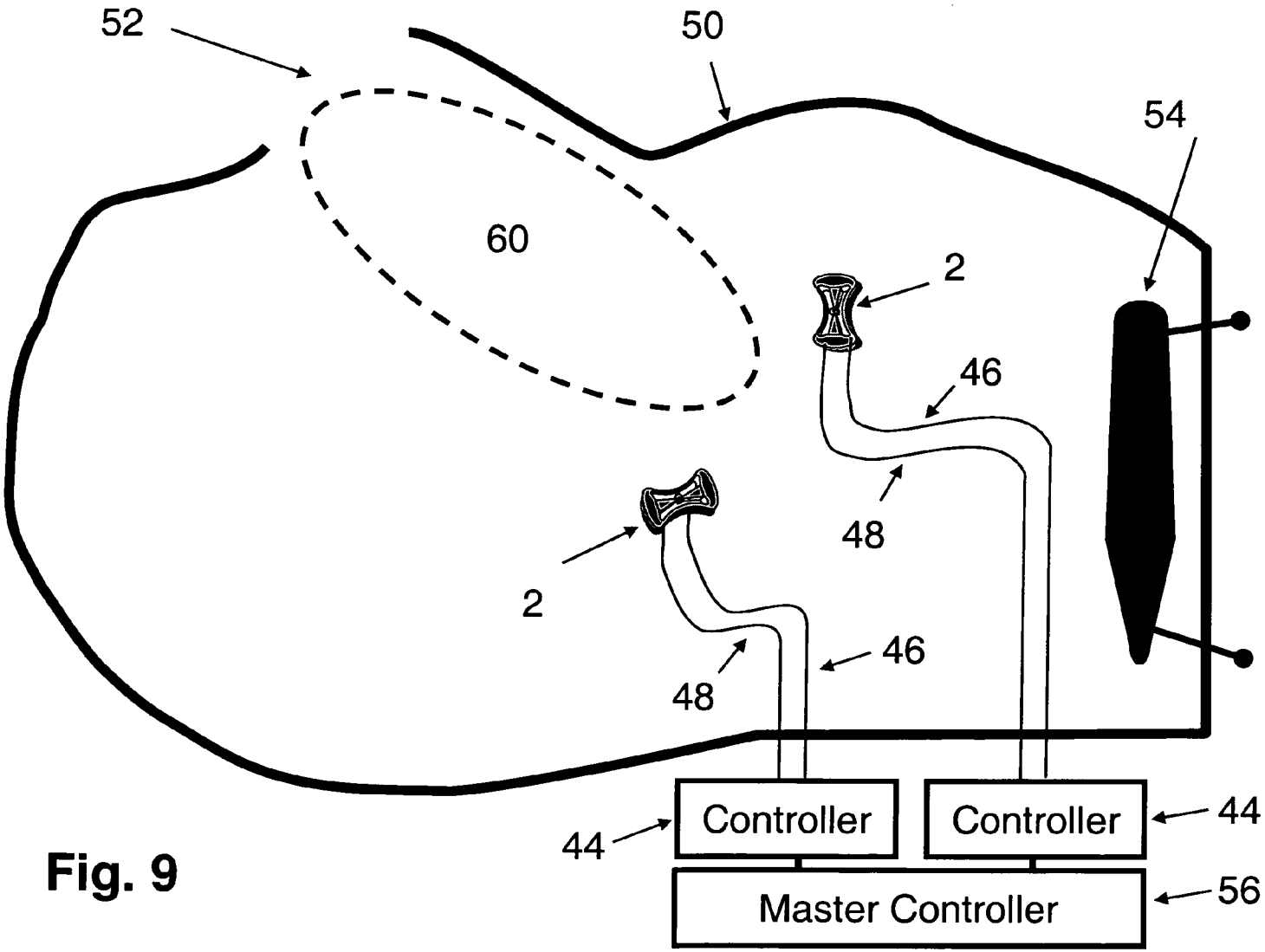
FIG. 9 is an illustration of multiple transducers of the present invention in a harbor installation intended for protection of a moored vessel.

FIG. 9 illustrates an example of ship protection in a harbor using two systems such as those of FIG. 8. The harbor perimeter 50 has an inlet 52 for access. Ship 54 is shown moored to a pier in the harbor. It is desired to create a high sound intensity in region 60 of the harbor to thwart potential waterborne swimmer or diver terrorists. By placing two transducers 2 in the correct locations, controlling their phase and amplitude jointly by master controller 56 through their individual controllers 44, the sound waves produced may be in phase in region 60 and thereby of greater magnitude that that of a single transducer.

Additional transducers may be used, employing methods known as beamforming. In addition, certain properties of the topography of the harbor floor may be taken in to account to provide maximum sound pressure levels at desired locations. These methods for employing multiple transducers are well known to those versed in underwater acoustics.

Those skilled in the art will also appreciate that this transducer is a low-cost solution for systems that can be deployed from different platforms such as a pier facility; large ship; small boat and unmanned underwater and surface vehicles. The size, weight and power source of the method and apparatus of the present invention are applicable to piers and ships. Versions suitable for small boats are also possible.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A transducer for producing underwater sound comprising:

an exterior shell;

opposed interior arms fixedly attached directly to said exterior shell at opposed positions on said shell and extending inwardly from the exterior shell to inner terminal ends, said shell adapted to urge said arms inwardly against a rotating cam; and a rotating cam in contact with said inner terminal ends of said opposed interior arms for moving said arms outwardly and inwardly.

2. The transducer of claim 1, wherein the rotating cam is driven by a motor.

3. The transducer of claim 2, where the motor is an electric motor or an air motor.

4. The transducer of claim 2, where the motor is controlled by means to vary the rotational speed of the motor.

5. The transducer of claim 4, where the motor controller means maintains a constant rotational speed, once a rotational speed is selected.

6. The transducer of claim 1, wherein the exterior shell is in the form of a flextensional shell.

7. The transducer of claim 1, wherein the rotating cam has an elliptical shape.

8. The transducer of claim 1, wherein the rotating cam has more than two lobes.

9. The transducer of claim 1, wherein the rotating cam has an axial taper.

10. The transducer of claim 9, wherein means are provided for moving said axially tapered, rotating cam in the space between said arms to adjust the mechanical displacement of said arms.

11. The transducer of claim 1, wherein the rotational position of the cam with respect to said shell is sensed by an encoder.

12. The transducer of claim 11, where the encoder is one of: a potentiometer; an optical encoder; a Hall device; and a digital optical encoder.

13. The transducer of claim 11, wherein means are provided to vary the relative rotational position of the cam with respect to said transducer shell during rotation.

14. An underwater sound system consisting of multiple transducers spaced apart by known dimensions:

where each transducer shell is driven by rotating cam; and each transducer has a sensor for measuring the rotational position of the cam with respect to the transducer shell; and means for adjusting the relative angular position of said cam with respect to said cams in other transducers while said cam is rotating; and means for coordinating all said cam positions to create a maximum sound pressure level at a predetermined location.

* * * * *